US006994343B2

(12) United States Patent
Blazek et al.

(10) Patent No.: US 6,994,343 B2
(45) Date of Patent: Feb. 7, 2006

(54) BRAIN TWISTER

(76) Inventors: Zdenek Blazek, Kotlarska 36, CZ-602 00 Brno (CZ); Miroslav Jandora, Frycajova187CZ-169 00, Brno (CZ)

( * ) Notice: Subject to any disclaimer, the term of this patent is extended or adjusted under 35 U.S.C. 154(b) by 0 days.

(21) Appl. No.: 10/271,748

(22) Filed: Oct. 17, 2002

(65) Prior Publication Data

US 2003/0030212 A1 Feb. 13, 2003

Related U.S. Application Data

(63) Continuation-in-part of application No. 09/463,217, filed as application No. PCT/CZ98/00031 on Jul. 14, 1998, now abandoned.

(30) Foreign Application Priority Data

Jul. 21, 1997 (CS) ..... 2311-97

(51) Int. Cl.
*A63F 9/08* (2006.01)

(52) U.S. Cl. ..... 273/153 S

(58) Field of Classification Search ..... 273/153 S, 273/153 R, 157 R, 156
See application file for complete search history.

(56) References Cited

U.S. PATENT DOCUMENTS

| | | | | |
|---|---|---|---|---|
| 3,547,444 A | | 12/1970 | Williams | |
| 3,674,276 A | | 7/1972 | Street et al. | |
| 4,415,158 A | * | 11/1983 | Engel | 273/153 S |
| 4,674,750 A | | 6/1987 | Abu-Shumays et al. | |
| 4,889,340 A | * | 12/1989 | Greene | 273/153 S |
| 4,978,126 A | | 12/1990 | Morosow et al. | |
| 5,104,125 A | | 4/1992 | Wilson | |
| 5,114,377 A | | 5/1992 | Mercuri et al. | |
| 5,116,052 A | | 5/1992 | Pop | |
| 5,135,225 A | | 8/1992 | Pszotka et al. | |
| 5,389,063 A | * | 2/1995 | Wu | 273/153 S |
| 5,411,262 A | | 5/1995 | Smith | |

FOREIGN PATENT DOCUMENTS

| | | | | |
|---|---|---|---|---|
| DE | 3205546 | * | 11/1982 | 273/153 S |
| DE | 31 27 757 A | | 2/1983 | |
| DE | 295 11 122 U | | 2/1996 | |
| EP | 0 072 215 A2 | | 2/1983 | |
| EP | 512928 | * | 11/1992 | 273/153 S |
| FR | 908 305 | | 9/1945 | |
| FR | 2 570 799 | | 3/1986 | |
| GB | 2 107 595 A | | 5/1983 | |
| SU | 1321433 | * | 7/1987 | 273/153 S |
| SU | 1405870 | * | 6/1988 | 273/153 S |
| WO | WO 94/04236 | | 3/1994 | |

* cited by examiner

*Primary Examiner*—Steven Wong
(74) *Attorney, Agent, or Firm*—Venable LLP; Robert Kinberg; Catherine M. Voorhees

(57) ABSTRACT

A brain twister includes an inner structure and a plurality of movable elements and a plurality of stationary elements arranged on the inner structure. The movable elements are arranged to orbit about the stationary elements. At least three of the moveable elements and one of the stationary elements form a group. The moveable elements in the group are arranged to move around the stationary element of the group. The brain twister includes a plurality of groups. Each moveable element forms a part of at least two of the groups.

18 Claims, 5 Drawing Sheets

BRAIN TWISTER

CROSS-REFERENCE TO RELATED APPLICATIONS

The present application is a continuation-in-part of U.S. patent application Ser. No. 09/463,217 filed Apr. 24, 2000 now abdn. entitled "Brain Twister" to Zdenek Blazek which is a U.S. national stage of International application PCT/CZ98/00031 filed Jul. 14, 1998, claiming priority to Czech Republic Application No. PV 2311-97 filed Jul. 21, 1997. The contents of each of the foregoing documents are incorporated herein by reference in their entirety.

BACKGROUND OF THE INVENTION

1. Field of the Invention

This invention relates to a brain twister having flat elements movable relative to each other and arranged as an envelope on a ball-shaped inner construction.

2. Related Art

Brain twisters are special toys which aim to exercise imagination and combination skills. Brain twisters are constructed as groups or arrangements of elements movable relative to one another. These elements are usually painted with various colors on their surfaces, or printed with segments of a picture. The task of the user is to arrange a geometrical shape or picture by displacement of these elements to "solve" the brain twister. The elements can usually be displaced either individually or in rows or groups.

A typical example of a brain twister is a flat toy created by a frame in which square flat elements are placed. In the frame, there is an additional empty square to enable displacement of one or more of the flat elements in the empty space to allow rearrangement of the elements. However, this is a relatively simple toy for small children and does not attract older children or adults.

A more complicated brain twister is the "Rubic's cube" which was extremely popular in the early 1980's. Twenty seven (27) colored individual cubes are arranged in a 3×3×3 cube. Each of the walls of the cube represents a group of 9 cubes which can by twisted in two perpendicular planes. There are various paints or stickers on the individual cubes' surfaces and the task is solved when a complete color is formed on the sides of the entire cube. However, the Rubic's cube has a disadvantageous angular shape and the construction of the cube is relatively complicated.

SUMMARY OF THE INVENTION

The above mentioned insufficiencies are, to a considerable degree, eliminated by a brain twister in accordance with the present invention. The present invention includes a brain twister with a more agreeable shape, without sharp edges and sufficiently complicated to attract older children and adults by the possibility of creating pictures or images.

Movable or orbital elements are arranged into groups of at least three mutually separated and mutually movable elements. The movable elements are movable in a group about a point in the scope of 360°. The movable elements are arranged symmetrically around an additional central element to form the group. At least one of the orbital elements of each group is also a part of an adjacent group. All of the movable elements of the brain twister create an infinite and closed chain in all directions. The elements are arranged into a shape of a ball or other curved surface.

In a preferred embodiment, there are five orbital elements and one central element in a single group. The central elements are substantially flat and have a shape of a pentagon, and the orbital elements are substantially flat and have a shape of a hexagon.

Preferably, the central flat elements are firmly mounted on a ball-shaped inner construction and the movable elements are arranged around the central elements.

Preferably, the central elements have smaller real or imaginary diameters than the movable elements.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF AN EXEMPLARY EMBODIMENT OF THE PRESENT INVENTION

A preferred embodiment of the invention is discussed in detail below. While specific exemplary embodiments are discussed, it should be understood that this is done for illustration purposes only. A person skilled in the relevant art will recognize that other components and configurations can be used without parting from the spirit and scope of the invention.

Figure 1:
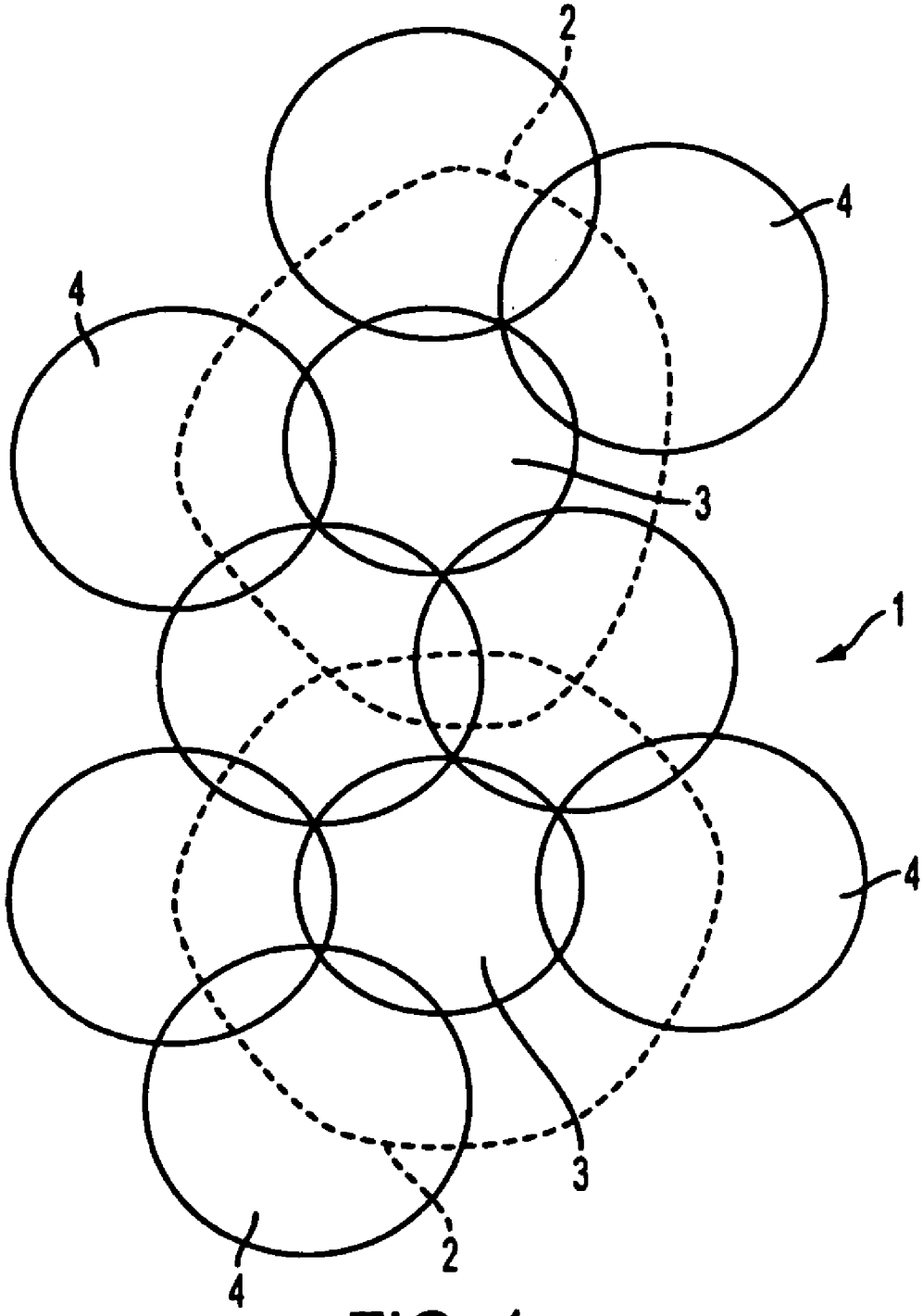
FIG. 1 illustrates a schematic representation of the movable elements surrounding the central elements.

A brain twister 1 in accordance with the present invention is preferably spherical, but for illustration purposes, FIG. 1 illustrates a view of a planary spread envelope created by circular elements 3, 4. The envelope covers a ball-shaped inner construction (not illustrated in FIG. 1) and is created by groups 2 of flat elements 3, 4 which are slightly curved to be arranged on the ball structure. The groups 2 preferably include six elements 3, 4, wherein one of the elements 3, 4 in the group 2 is a central flat element 3 and the remaining elements are movable or orbital flat elements 4 arranged symmetrically around the central flat element 3. Each central flat element 3 has, in this embodiment, about a 20% smaller diameter than the orbital flat elements 4. The elements 3 of a particular group 2 create a compact loop around and the central element 3 of the particular group. In an alternative embodiment, all the elements are the same size, and every element 3, 4 can represent, in a certain moment, a central or an orbital element. By individual and successive circular movements of the orbital elements 4, the orbital elements 4 are displaced into the adjacent groups 2 of other orbital flat elements 4 and around the central elements 3. It is possible to have groups 2 of flat elements 3, 4 which include at least three orbital elements 4 arranged symmetrically around one central element 3, wherein all of the flat elements 3, 4 are moveable relative to each other in the scope of 360°. However, in this alternative embodiment, there would be relatively large gaps between the orbital elements 4, which would be necessary to fill for aesthetic reasons.

Figure 2:
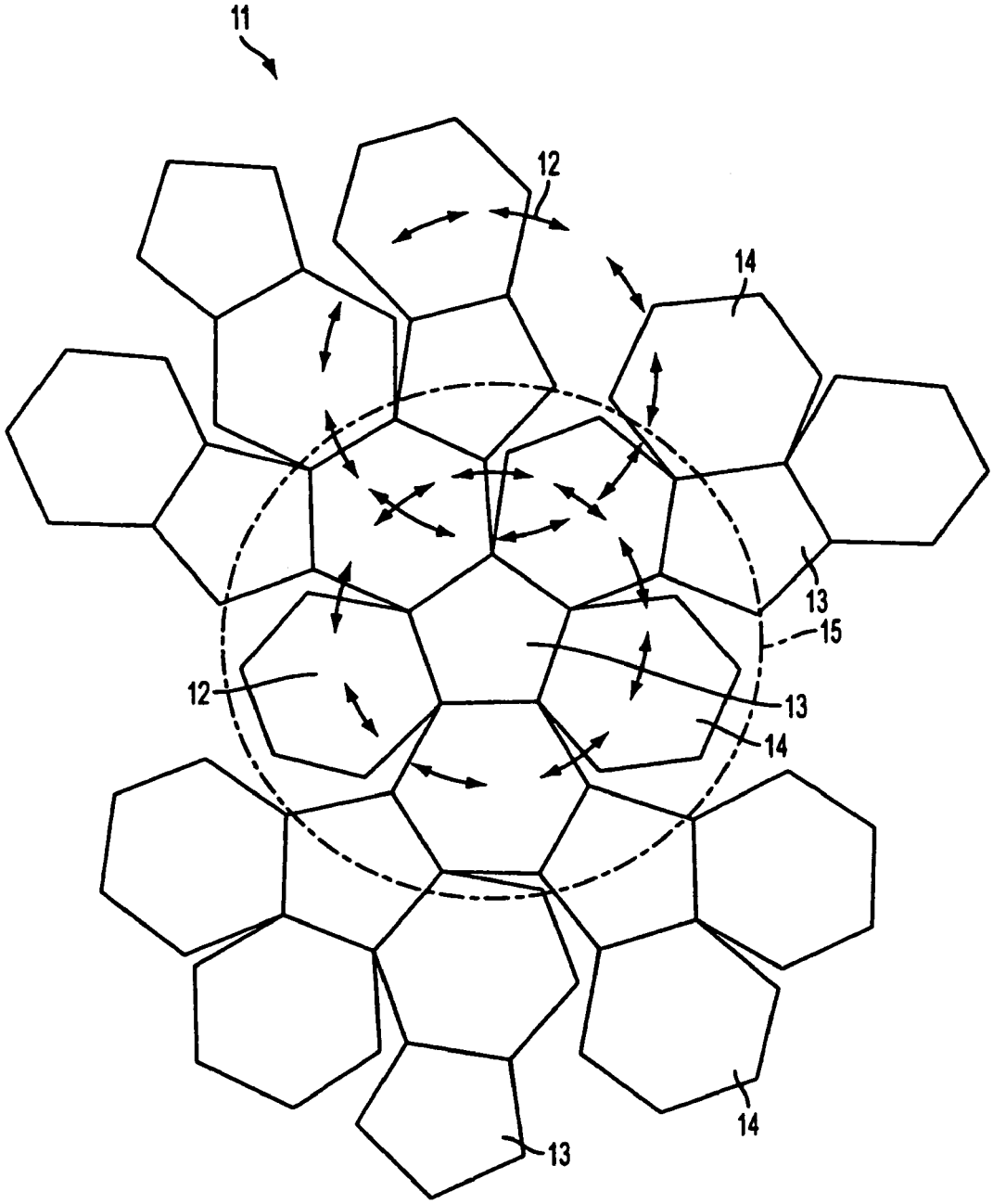
FIG. 2 shows one embodiment of the brain twister with the central elements as pentagons and the movable elements as hexagons.

An advantageous embodiment of the brain twister 11 is shown in FIG. 2. In this case, the planary spread envelope is created by pentagonal and hexagonal elements 13, 14. The central elements 13 are pentagon shaped and the orbital elements 14 are hexagon shaped. The elements 13, 14 are arranged on an inner structure 15. The orbital elements 14 can move about path 12. As can be seen from the picture, each movable element 14 is a part of three groups in any single position and is movable in one of three different paths in a single movement. Each central pentagonal element 13 has, in this embodiment, a smaller imaginary diameter of about 20% less than each orbital hexagonal elements 14.

In both of the above embodiments, each of the orbital elements of a particular group is also a part of an adjacent group of elements, which also includes orbital elements and one central element. All the movable elements create an infinite and closed chain movable in all directions, and the chains are arranged into the ball-shaped envelope carried on the ball-shaped inner construction.

Figure 3:
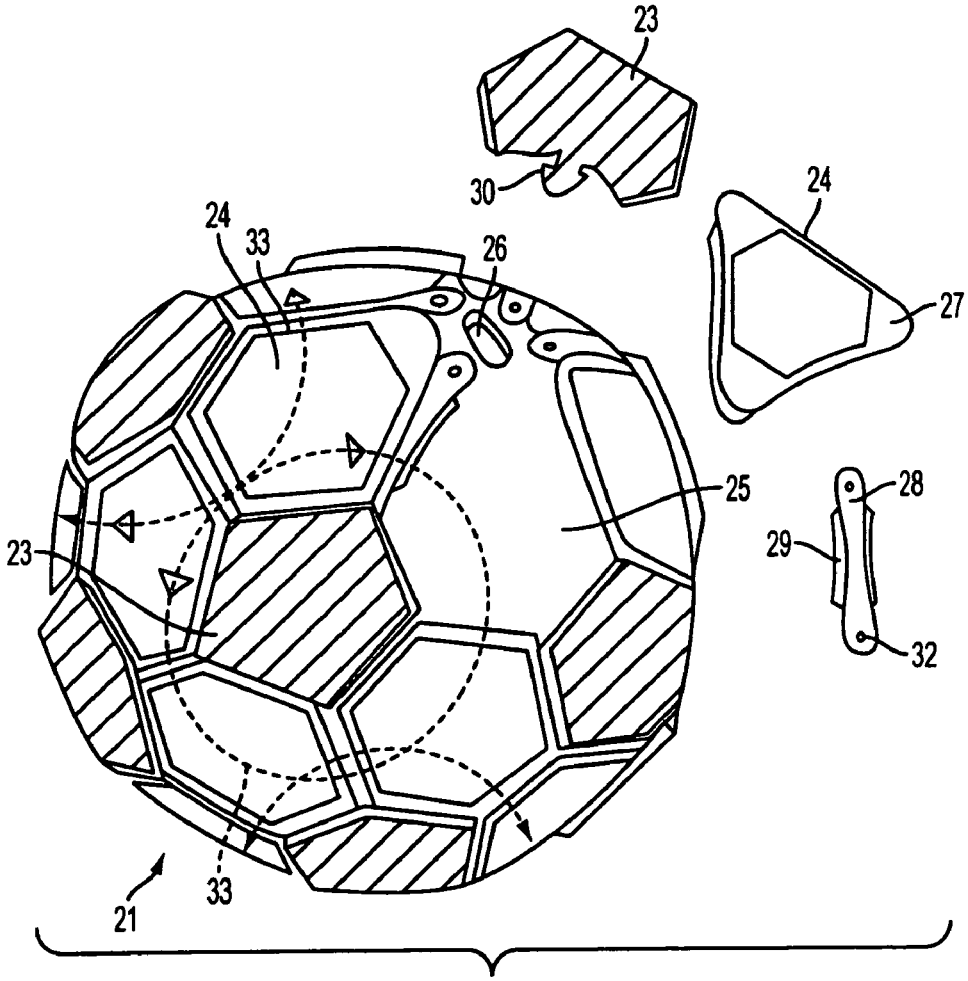
FIG. 3 illustrates the preferred embodiment of a completed brain twister.

FIG. 3 shows the preferred embodiment of a complete brain twister. The brain twister in FIG. 3 is slightly exploded in areas to clearly show the arrangement and construction of the brain twister. The brain twister includes an interior ball structure 25. The ball structure 25 is a smooth sphere and can be hollow. The surface of the ball 25 is covered by orbital sliding elements 24 and stationary elements 23 which are substantially flat. Each of the stationary elements 23 are mounted on the ball 25, preferably with a detent 30 placed in a hole 26 on the ball 25. A plurality of orbital elements 24 surround the stationary element 23 to form a group of elements. Preferably, there are five orbital elements 24 around each stationary element 23 to form a single orbital group. In the preferred embodiment, the brain twister includes twelve stationary elements 23 and twenty orbital elements 24, although it is clear that more or less elements can be provided, depending on the desired size, complexity, and appearance of the brain twister.

The stationary elements 23 are pentagons and the orbital elements 24 appear to be hexagons. The orbital elements 24 are actually triangular with extensions 27 that form the three corners of the triangular structures 24. The extensions 27 are arranged underneath the stationary elements 23 to secure the orbital elements 24 on the ball structure 25. The extensions 27 enable the orbital elements 24 to orbit completely around the stationary elements 23. During rotation of the orbital elements 24, the stationary elements 23 also extend over a portion of the sides of the elements. In any position of the orbital elements 24, the stationary elements 23 extend over a portion of the orbital element 24 in at least two places to ensure that the slidable element 24 is not detached from the inner structure 25.

Each of the orbital elements 24 can orbit about any of the three immediately adjacent stationary elements. Any individual orbital element 24 can occupy any orbiting position on the brain teaser by successively orbiting about the stationary elements 23 as parts of different orbiting groups.

In the preferred embodiment, there is a slight spacing between each of the orbiting elements 24. A spacing element 28 is placed between the orbiting elements to fill these spaces. Preferably, the spacing elements 28 are elongated with the ends slightly larger than the middle and have slight wings 29 in the center. The spacing elements 28 can have slight protrusions 32 which can act as positioners to ensure a proper position underneath the stationary elements. The spacing elements 28 aid in the sliding movement and can slide with the orbital elements 24. Arrows on path 33 show some of the ways the orbital elements 24 can move about stationary elements 23.

Figure 4:
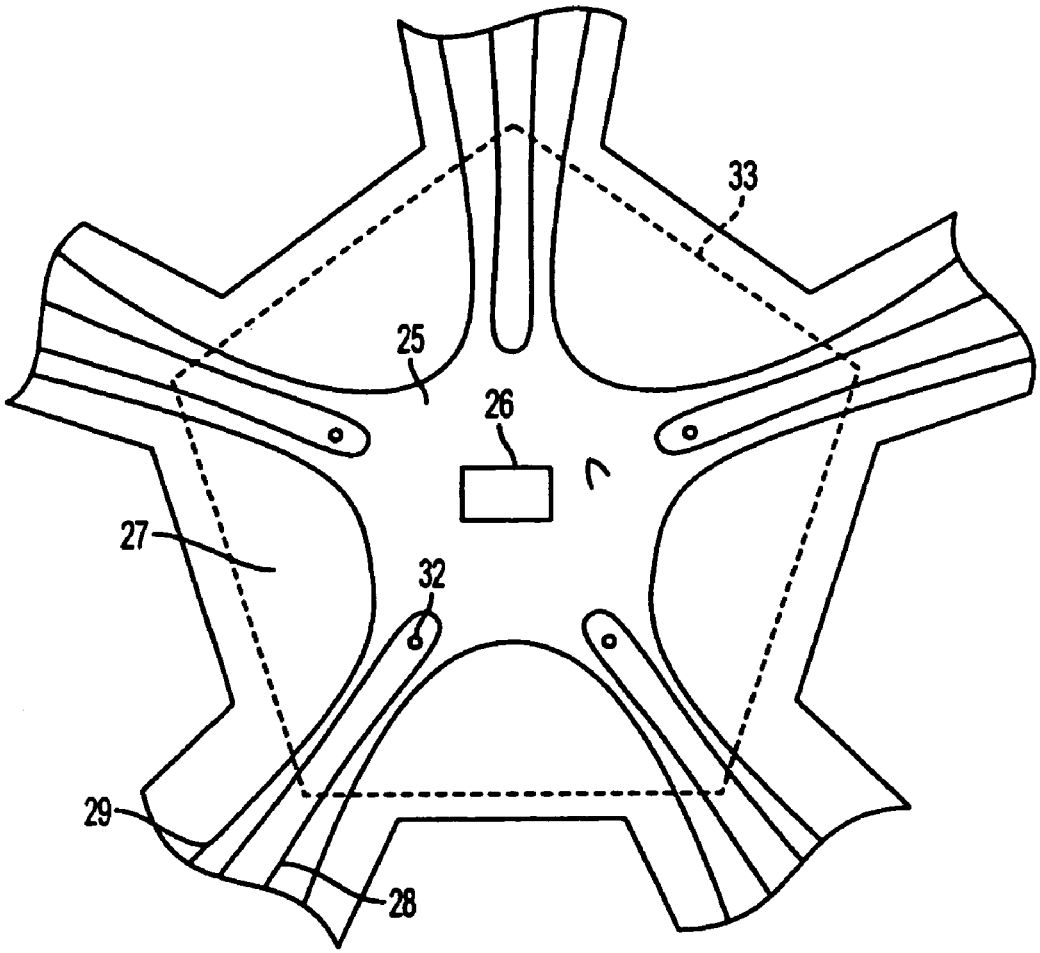
FIG. 4 is an enlarged partial view of the brain twister of FIG. 3 with one of the stationary elements removed.

FIG. 4 shows an enlarged sectional view of the brain twister of FIG. 3 with one of the stationary elements 23 removed. Dashed line 33 represents the position the stationary element 12 would occupy. As can be seen, when in place on the ball structure, the stationary element 23 extends partially over the extensions 27 and the spacing element 28 is secured to the inner structure 25 in slot 24.

Figure 5:
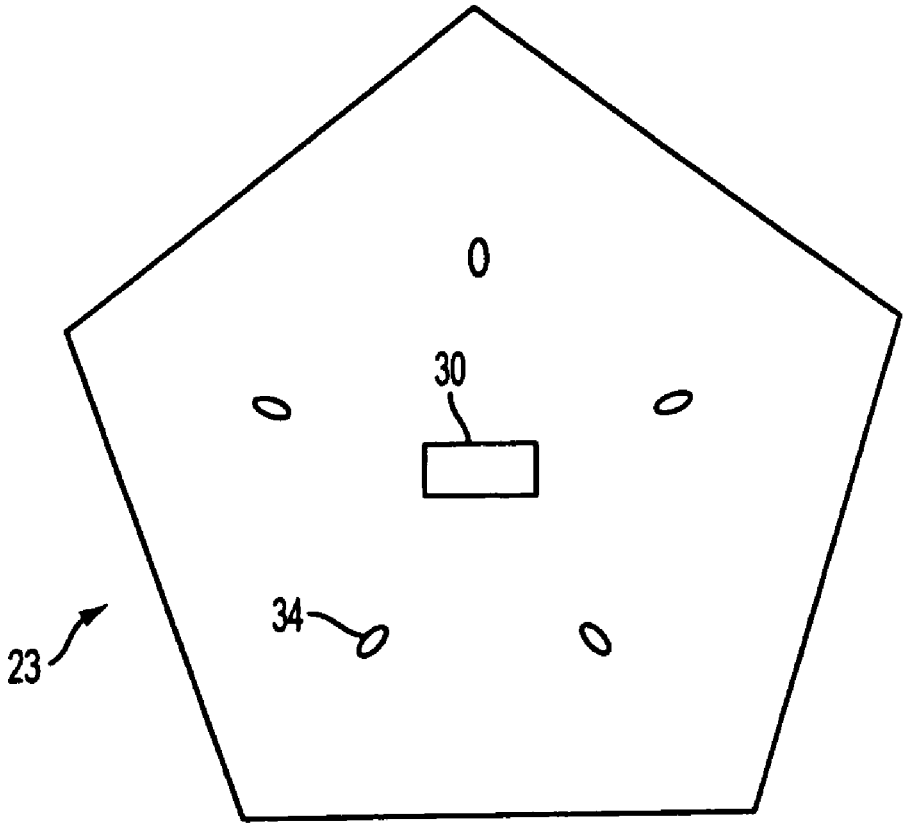
FIG. 5 is an enlarged view of the underside of a stationary element shown in FIG. 4.

FIG. 5 shows the underside of one of the stationary elements 23 with the detent 30. Although a simple detent 30 is shown, other arrangements for securing the stationary element can be used, for example, opposing resilient hook shaped elements. Slight recesses 34 are also provided in the stationary element 23 that correspond to the protrusions 32 on the spacing elements 28 and aid in positioning the movable elements 24.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A brain twister comprising:

an inner structure; and a plurality of movable elements arranged in groups, wherein movable elements in a group are adjacent to respective movable elements thereby forming a chain and are arranged to move together in the chain about a stationary point; and a plurality of non-rotating, stationary elements arranged on the inner structure, wherein movable elements are arranged to orbit about the stationary elements in a single movement, and wherein the plurality of non-rotating, stationary elements form at least part of an outer surface of the brain twister.

2. The brain twister of claim 1, wherein at least three of the moveable elements form a group, the at least three moveable elements in the group being arranged to move around one of the plurality of non-rotating, stationary elements, the brain twister having a plurality of groups, wherein each moveable element forms a part of at least two of the plurality of groups and is configured to orbit a first stationary element in a single movement when part of a first group and is configured to orbit a second stationary element in another single movement when part of a second group.

3. The brain twister of claim 1, wherein the inner structure is a sphere.

4. The brain twister of claim 1, wherein the stationary elements are pentagons and the movable elements are hexagons.

5. The brain twister of claim 4, wherein the pentagons and hexagons are arranged as a spherical soccer ball.

6. The brain twister of claim 2, wherein five movable elements form one group.

7. The brain twister of claim 1, wherein each of the movable elements and stationary elements have a diameter, the diameter of each of the movable elements being greater than the diameter of each of the stationary elements.

8. The brain twister of claim 1, wherein the stationary elements are mounted on the inner structure.

9. The brain twister of claim 8, wherein each of the movable elements, has an extension area which is arranged between the stationary elements and the inner structure to retain the movable elements on the inner structure.

10. The brain twister of claim 1, wherein the stationary elements and the movable elements are substantially flat and slightly curved.

11. The brain twister of claim 1, further comprising spacing elements between each of the movable elements wherein each spacing element is of a length that is slightly longer than a moveable element and is substantially narrower than the width of a moveable element and is configured to fill the slight spacing between each of the moveable elements.

12. The brain twister of claim 11, wherein the length of each spacing element has a protrusion at each end, which acts as a positioner in conjunction with the underside of a stationary element to ensure proper positioning of a movable element when it is part of a group that orbits the respective stationary element.

13. The brain twister of claim 12, wherein the stationary elements have an inner face which have recesses corresponding to the protrusions on the spacing elements to aid in positioning the movable elements.

14. The brain twister of claim 1, wherein each of the stationary elements and the movable elements have a top side and an underside, and wherein the undersides of all of the movable and stationary elements contact the inner structure.

15. The brain twister of claim 2, wherein the inner structure defines moveable element positions and stationary element positions, wherein each moveable element is arranged to be positioned in any moveable element position on the inner structure.

16. A brain twister comprising:

an inner structure;

a plurality of movable elements arranged symmetrically around a stationary point to form a group;

a plurality of non-rotating, stationary elements that serve as stationary points arranged on the inner structure, wherein a number of groups of the movable elements are arranged to form a compact loop about and orbit about each stationary element in a single movement; and spacing elements are disposed between each of the movable elements wherein each spacing element is of a length that is slightly longer than a moveable element and is substantially narrower than the width of a moveable element and is configured to fill the slight spacing between each of the moveable elements, and wherein the spacing elements have protrusions on each end of the length and the stationary elements have an inner face which has recesses corresponding to the protrusions on the spacing elements so that the protrusions of the spacing elements serve as positioners to ensure that the movable elements are in a proper position to form a group that orbits about a stationary element when the protrusions are received in the recesses.

17. A brain twister comprising:

an inner structure; and a plurality of movable elements and a plurality of non-rotating, stationary elements arranged on the inner structure, wherein a plurality of movable elements surround each stationary element to form a group and a number of groups are formed so that each group is arranged to orbit about a respective stationary element, wherein the stationary elements are mounted on the inner structure and the movable elements have extensions which are arranged underneath the stationary elements between the stationary element and the inner structure to movably secure the movable elements to the inner structure and to retain the movable elements on the inner structure, each movable element having a polygonal area surrounded by an area forming the extension of a different thickness where the extensions extend from the polygonal area.

18. The brain twister of claim 17, wherein the stationary elements are arranged on the inner structure so that three stationary elements are adjacent a respective moveable element so that each of the movable elements are moveable around any of three adjacent stationary elements in a single movement.

* * * * *

UNITED STATES PATENT AND TRADEMARK OFFICE

CERTIFICATE OF CORRECTION

PATENT NO. : 6,994,343 B2
DATED : February 7, 2006
INVENTOR(S) : Zdenek Blazek et al.

It is certified that error appears in the above-identified patent and that said Letters Patent is hereby corrected as shown below:

Title page,
Item [63], Related U.S. Application Data, insert -- Continuation-in-part of 09/463,217 filed on 04/24/2000, which is a 371 of PCT/CZ98/00031 filed 07/14/1998, now abandoned. --.

Signed and Sealed this

Twenty-third Day of May, 2006

JON W. DUDAS
*Director of the United States Patent and Trademark Office*